US011035128B2

(12) United States Patent
Steffes et al.

(10) Patent No.: US 11,035,128 B2
(45) Date of Patent: Jun. 15, 2021

(54) EXTERIOR CLADDING PANELS AND METHODS FOR INSTALLING THEM

(71) Applicant: CertainTeed LLC, Malvern, PA (US)

(72) Inventors: Stephen W. Steffes, McPherson, KS (US); David J. Stucky, Grass Lake, MI (US); Robert D. Shaw, Parma, MI (US); Brian W. Kirn, Hatboro, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/365,337

(22) Filed: Mar. 26, 2019

(65) Prior Publication Data

US 2019/0301175 A1 Oct. 3, 2019

Related U.S. Application Data

(60) Provisional application No. 62/650,328, filed on Mar. 30, 2018.

(51) Int. Cl.
*E04F 13/08* (2006.01)
*E04F 13/18* (2006.01)

(52) U.S. Cl.
CPC ..... *E04F 13/0894* (2013.01); *E04F 13/0864* (2013.01); *E04F 13/185* (2013.01); *E04F 2201/0138* (2013.01)

(58) Field of Classification Search
CPC .. E04F 13/0894; E04F 13/0864; E04F 13/185
USPC ..... 52/588.1
See application file for complete search history.

(56) References Cited

U.S. PATENT DOCUMENTS 2,013,391 A * 9/1935 Searls ..... E04D 1/26 52/523
2,918,814 A * 12/1959 Farina ..... E04F 13/142 52/513
3,229,436 A * 1/1966 Gerhart ..... E04F 13/0864 52/521
3,233,382 A * 2/1966 Graveley, Jr. ..... E04F 13/0864 52/522
3,819,395 A * 6/1974 Yocum ..... B28B 11/0863 427/264
3,868,300 A * 2/1975 Wheeler ..... E04D 1/265 162/124

(Continued)

*Primary Examiner* — Brian D Mattei
*Assistant Examiner* — Joseph J. Sadlon
(74) *Attorney, Agent, or Firm* — McDonnell Boehnen Hulbert & Berghoff LLP

(57) ABSTRACT

One aspect of the disclosure is an exterior cladding panel including one or more courses of simulated shingles, a locking clip extending from a front face of the exterior cladding panel, and a locking leg extending from a rear face of the exterior cladding panel. The exterior cladding panel also includes a first plurality of tabs extending from a top edge of the exterior cladding panel, where each tab in the first plurality of tabs includes at least one projection extending approximately perpendicular to the front face. A respective top end of each tab in the first plurality of tabs extends a common distance from the top edge of the exterior cladding panel. A second plurality of tabs extends from the top edge of the exterior cladding panel, where a respective top end of each tab in the second plurality of tabs extends the common distance from the top edge.

19 Claims, 11 Drawing Sheets

(56) References Cited

U.S. PATENT DOCUMENTS 3,953,952 A * 5/1976 Middleby ..... E04D 13/064 52/511
3,968,610 A * 7/1976 Medow ..... E04F 13/0871 52/314
3,969,866 A * 7/1976 Kyne ..... F16B 5/0664 52/588.1
4,279,106 A * 7/1981 Gleason ..... E04D 1/2928 52/100
4,712,351 A * 12/1987 Kasprzak ..... E04F 13/0864 52/547
4,726,881 A * 2/1988 Schultz ..... B27N 3/20 162/109
4,961,295 A * 10/1990 Kosch, Sr. ..... A47F 5/0846 211/94.02
5,072,562 A * 12/1991 Crick ..... E04D 1/265 52/521
5,363,623 A * 11/1994 King ..... B29D 99/001 52/520
5,537,792 A * 7/1996 Moliere ..... E04F 13/0864 52/531
5,755,068 A * 5/1998 Ormiston ..... B32B 3/30 52/314
5,794,396 A * 8/1998 Gibbs ..... E04D 1/16 52/518
5,927,044 A * 7/1999 Lamb ..... B29C 51/34 249/160
6,311,436 B1 * 11/2001 Mimura ..... E04D 1/365 52/173.3
6,345,479 B1 * 2/2002 Hutchison ..... B29C 45/14336 428/195.1
6,393,792 B1 * 5/2002 Mowery ..... E04F 13/18 52/506.05
6,526,717 B2 * 3/2003 Waggoner ..... E04F 13/08 52/554
6,598,362 B2 * 7/2003 Hikai ..... E04F 13/0846 52/235
6,976,342 B1 * 12/2005 Kowalevich ..... E04F 13/0864 52/520
7,225,592 B2 * 6/2007 Davis ..... E04F 13/0864 24/293
D568,496 S * 5/2008 Trabue ..... A47F 5/0846 D25/102
7,413,374 B2 * 8/2008 Rogers ..... E01C 9/086 404/35
7,478,507 B2 * 1/2009 Krause ..... E04F 13/0832 52/546
7,617,749 B2 * 11/2009 Kelland ..... B25D 1/02 81/23
7,698,864 B2 * 4/2010 Justice ..... E04F 13/0864 52/519
D618,367 S * 6/2010 Schwarz ..... E04F 13/0864 D25/151
7,730,673 B2 * 6/2010 George ..... E04F 17/06 52/107
7,735,287 B2 * 6/2010 Gaudreau ..... E04D 1/265 52/526
7,803,467 B2 * 9/2010 Dorsy ..... E04C 2/427 428/596
7,963,499 B2 * 6/2011 Fitzgerald ..... E04F 13/185 249/16
7,980,037 B2 * 7/2011 Trabue ..... E04D 1/265 52/522
7,980,038 B2 * 7/2011 O'Neal ..... E04F 13/0864 52/551
8,136,316 B2 * 3/2012 Schwarz ..... E04F 13/0864 52/288.1
8,322,099 B2 * 12/2012 Reid ..... E04F 13/0862 52/387
8,387,325 B2 * 3/2013 Mullet ..... E04B 1/66 52/526
8,407,962 B2 4/2013 Cahill
8,516,765 B2 * 8/2013 Shaw ..... B32B 27/20 52/553
8,707,649 B2 * 4/2014 Wilkie ..... E04F 13/0892 52/533
8,875,463 B2 * 11/2014 Plagemann ..... E04C 2/46 52/559
8,997,423 B2 * 4/2015 Mann ..... E04F 13/0873 52/477
9,297,168 B2 * 3/2016 Kim ..... E04F 13/0805
9,482,011 B2 11/2016 Steffes
9,523,202 B2 * 12/2016 Anderson ..... E04D 3/30
10,787,814 B2 * 9/2020 Duque ..... B32B 1/00
2006/0032527 A1 * 2/2006 Stevens ..... H01L 31/048 136/251
2007/0107356 A1 5/2007 Steffes
2009/0293401 A1 * 12/2009 Lappin ..... E04D 1/265 52/478
2017/0114548 A1 4/2017 Steffes
2019/0301173 A1 10/2019 Steffes

* cited by examiner

EXTERIOR CLADDING PANELS AND METHODS FOR INSTALLING THEM

CROSS-REFERENCE TO RELATED APPLICATIONS

This application claims the benefit of priority of U.S. Provisional Patent Application No. 62/650,328, filed Mar. 30, 2018, which is hereby incorporated herein by reference in its entirety.

BACKGROUND OF THE DISCLOSURE

1. Field of the Disclosure

The present disclosure relates generally to exterior cladding products and methods for installing and fabricating them. The present disclosure relates more particularly to exterior cladding panels, such as siding panels.

2. Technical Background

Polymer-based siding, such as polypropylene or vinyl siding, is among the most common exterior cladding systems used for residential construction in the United States. Polymer siding is typically manufactured into relatively large panels that include a series of adjacent siding courses that imitate the appearance of traditional wood siding. For example, some siding panels may simulate the appearance of cedar shake siding, which is formed from a series of cedar shingles. The siding panels are often installed with the siding courses in a horizontal orientation, and a given panel is usually engaged with the panels above and below it by way of interlocking clips or hooks included at the top and bottom of each panel. The result is an exterior cladding system that can be installed more easily, quickly, and more economically that many other alternatives.

The simulated appearance of traditional wood siding, such as cedar shake siding, may result in an exterior cladding panel that is somewhat irregularly shaped. For instance, in a multi-course siding panel, the side edges of the siding panel may have a staggered profile, such that the simulated shingles in the adjacent courses within the panel do not end at the same location. Further, the bottom edge of the siding panel may have a slightly irregular profile, due to the slightly differing lengths of the simulated shingles in the bottommost siding course. In some situations, these differences in the siding panel from more typical work piece, which may have one or more straight edges, may provide challenges for the preparation and installation of the siding panel.

Accordingly, what is needed is an improved exterior cladding system that simulates a multi-course, wood shingle appearance while providing for ease of installation.

SUMMARY OF THE DISCLOSURE

One aspect of the disclosure is an exterior cladding panel comprising:

one or more courses of simulated shingles;

a locking clip extending from a front face of the exterior cladding panel, wherein the locking clip is positioned at a top end of the exterior cladding panel;

a locking leg extending from a rear face of the exterior cladding panel, wherein the locking leg is positioned along a bottom edge of the exterior cladding panel;

a first plurality of tabs extending from a top edge of the exterior cladding panel, wherein each tab in the first plurality of tabs comprises at least one projection extending approximately perpendicular to the front face of the exterior cladding panel and perpendicular to the top edge of the exterior cladding panel, and wherein a respective top end of each tab in the first plurality of tabs extends a common distance from the top edge of the exterior cladding panel; and a second plurality of tabs extending from the top edge of the exterior cladding panel, wherein a respective top end of each tab in the second plurality of tabs extends the common distance from the top edge of the exterior cladding panel.

Another aspect of the disclosure is an exterior cladding system comprising:

a first exterior cladding panel, wherein the first exterior cladding panel is the exterior cladding panel as described herein; and a second exterior cladding panel, wherein the second exterior cladding panel is the exterior cladding panel as described herein, wherein the locking leg of the second exterior cladding panel is sized to engage the locking clip of the first exterior cladding panel.

Another aspect of the disclosure is a wall of a structure comprising an exterior sheathing and the exterior cladding system described herein attached thereto, wherein the first exterior cladding panel is fastened to the exterior sheathing via a fastening strip disposed along the top edge of the first exterior cladding panel, and wherein the locking leg of the second exterior cladding panel is engaged with the locking clip of the first exterior cladding panel.

Another aspect of the disclosure is a method for installing an exterior cladding system as described herein, the method comprising:

fastening the first exterior cladding panel to the exterior sheathing via a fastening strip disposed along the top edge of the first exterior cladding panel;

engaging the locking leg of the second exterior cladding panel with the locking clip of the first exterior cladding panel;

applying a lateral force to at least one of the projections of one of the tabs in the first plurality of tabs of the second exterior cladding panel so as to laterally adjust a position of the second exterior cladding panel with respect to the first exterior cladding panel; and fastening the second exterior cladding panel to the exterior sheathing via a fastening strip disposed along the top edge of the second exterior cladding panel.

Another aspect of the disclosure is a method for forming an exterior cladding panel as described herein, the method comprising:

injection molding the exterior cladding panel to include:

one or more courses of simulated shingles;

a locking clip extending from a front face of the exterior cladding panel, wherein the locking clip is positioned at a top end of the exterior cladding panel;

a locking leg extending from a rear face of the exterior cladding panel, wherein the locking leg is positioned along a bottom edge of the exterior cladding panel;

a first plurality of tabs extending from a top edge of the exterior cladding panel, wherein each tab in the first plurality of tabs comprises at least one projection extending approximately perpendicular to the front face of the exterior cladding panel and perpendicular to the top edge of the exterior cladding panel, and wherein a respective top end of each tab in the first plurality of tabs extends a common distance from the top edge of the exterior cladding panel; and a second plurality of tabs extending from the top edge of the exterior cladding panel, wherein a respective top end of each tab in the second plurality of tabs extends the common distance from the top edge of the exterior cladding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventors have noted disadvantages of some conventional exterior cladding panels, such as polymer-based siding panels. For example, in some situations, a given siding panel may be too wide for certain areas of an installation, such as near the end of a wall or the gable ends of a house, and the siding panel may therefore need to be cut or trimmed to size in order to fit properly. However, as discussed above, some siding panels may have an intentionally irregular shape, which may make cutting the siding panel with precision difficult.

For instance, a cutting surface for a table saw or a miter saw frequently includes a fence, which is a long, straight support against which a work piece may be abutted during cutting, to brace the work piece in a desired position and to reduce the chances of the work piece moving or jumping during the cut. However, this generally requires the work piece to have at least one straight edge that may be abutted against the fence. Yet, an exterior cladding panel that simulates traditional cedar shake siding may include both side edges and a bottom edge that are not straight. Further, the top edge of the exterior cladding panel may not be straight either. For instance, the top edge may include features that serve as a gate for the injection molding process, or may be used for the lateral positioning of the exterior cladding panel.

The present inventors have determined that an exterior cladding panel may be formed, such as a polymer siding panel, for instance, that provides a simulated shingle appearance and includes tabs extending from the top edge of the exterior cladding panel. The tabs may be used for the lateral positioning of the exterior cladding panel during installation, and may also serve as an effective straight edge for abutting the exterior cladding panel against a saw fence to facilitate cutting of the exterior cladding panel.

Figure 1:
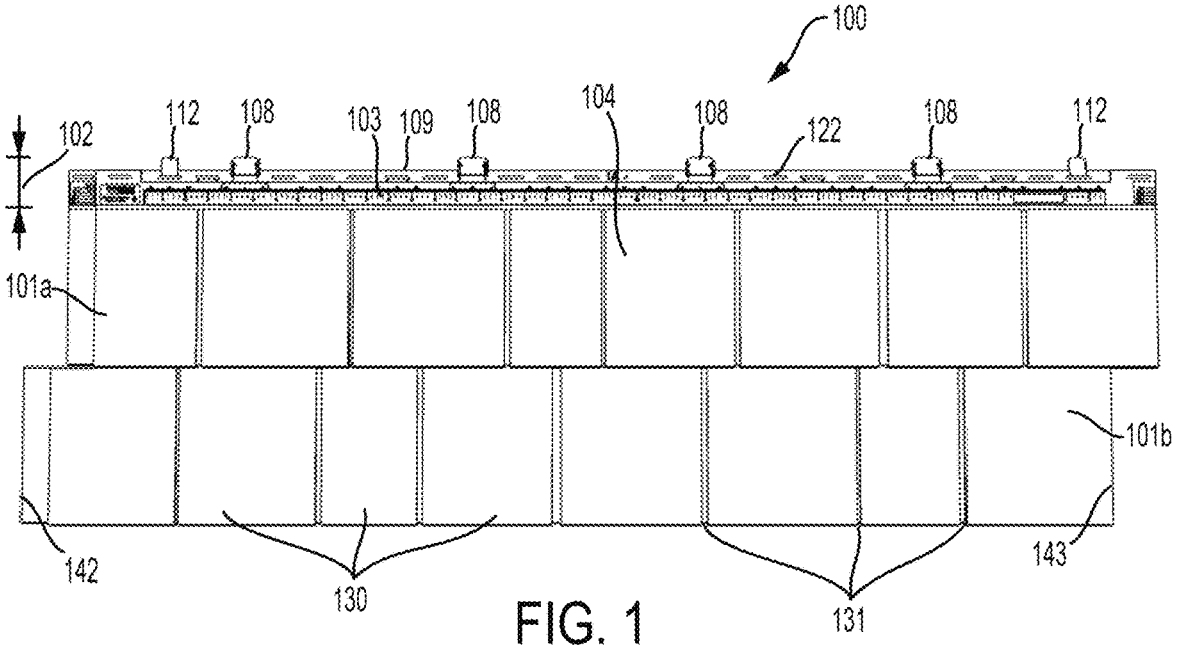
FIG. 1 is a schematic front view of an exterior cladding panel according to one embodiment of the disclosure.

Several embodiments of such an exterior cladding panel are described with respect to FIGS. 1-12 below. For example, FIG. 1 shows a schematic front view of an exterior cladding panel 100 according to one example discussed herein. The exterior cladding panel 100 may be, for instance, a polymer-based siding panel. The exterior cladding panel 100 may include one or more courses of simulated shingles. For instance, the exterior cladding panel 100 shown in FIG. 1 includes two courses—a first course 101*a* positioned above a second course 101*b*—simulating the appearance of traditional cedar shake siding.

Accordingly, each course of simulated shingles, such as the second course 101*b*, may include a series of simulated shingles 130 and a series of gaps 131 separating adjacent shingles in the series of simulated shingles, as shown in FIG. 1. Both the width of the individual shingles and the width of the gaps between shingles may be irregular, and randomized such that a repeating visual pattern is not readily perceived, even when multiple exterior cladding panels 100 are installed in series. For instance, each shingle in the series of shingles 130 may have a width that is different from both shingles adjacent to it. In some examples, every shingle in a given course may have a different width. Similarly, each gap in the series of gaps 131 may have a width that is different from at least one of the adjacent gaps.

The exterior cladding panel 100 may also include a locking clip 103 extending from a front face 104 of the exterior cladding panel 100. The locking clip 103 may be positioned at a top end 102 of the exterior cladding panel 100, as shown in FIG. 1, and which may be seen more clearly in the front perspective view of FIG. 3 or the side views in FIGS. 8 and 9.

In some embodiments as otherwise described herein, the locking clip 103 may be formed as a single, continuous locking clip that extends from approximately a first side 142 of the exterior cladding panel 100 to approximately a second side 143 of the exterior cladding panel 100. For instance, the continuous locking clip 103 may extend across the overall width of the exterior cladding panel 100 such that it is positioned above both the first and last shingles in the one or more courses, although it might not extend all the way to the end of the exterior cladding panel 100 at the first side 142.

Figure 2:
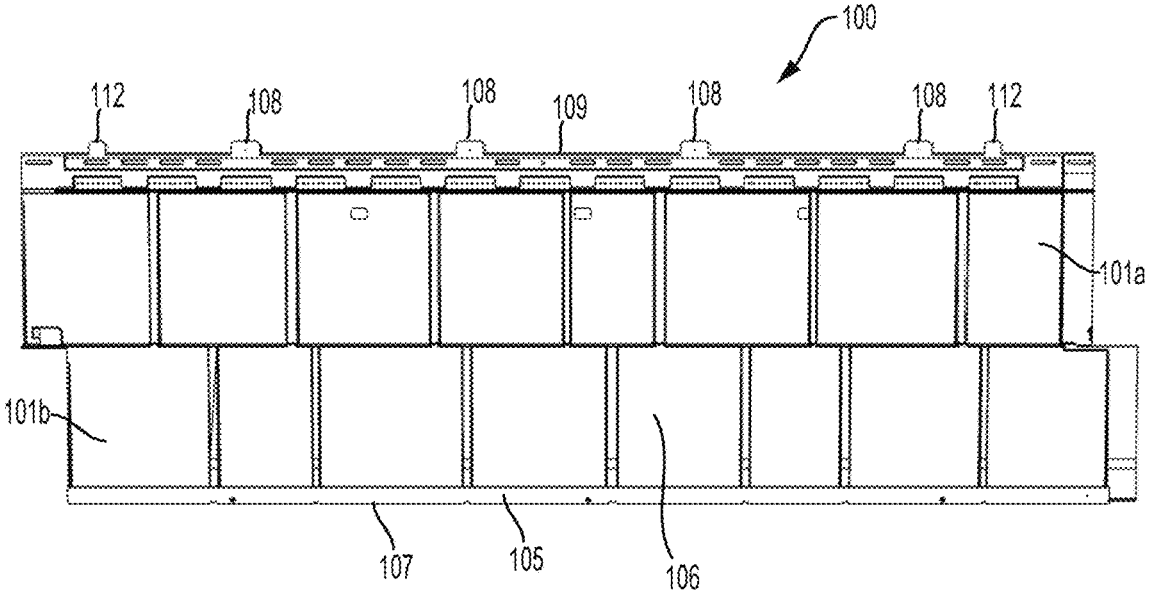
FIG. 2 is a schematic rear view of an exterior cladding panel according to another embodiment of the disclosure.
Figure 3:
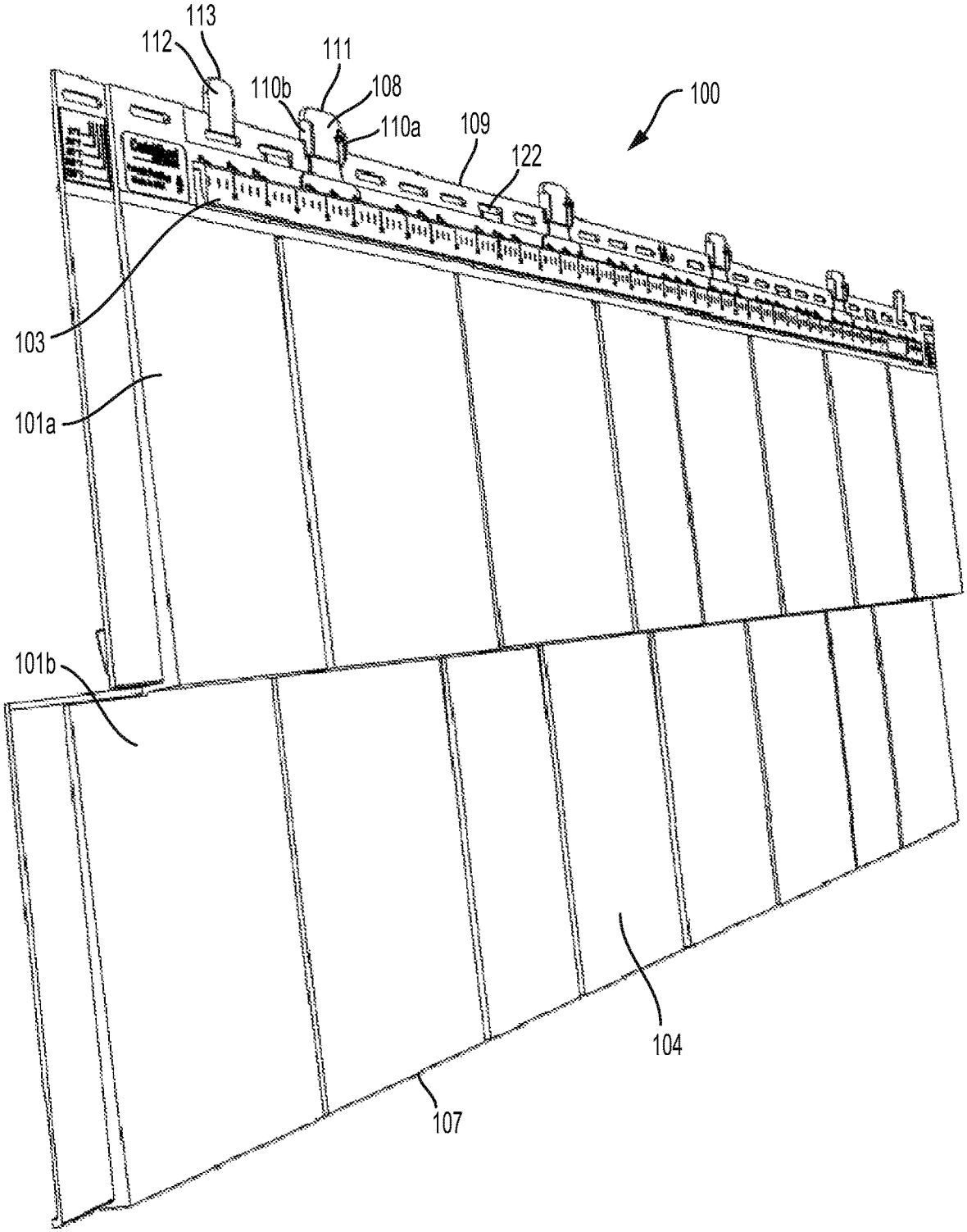
FIG. 3 is a schematic perspective view of a front face of an exterior cladding panel according to another embodiment of the disclosure.
Figure 4:
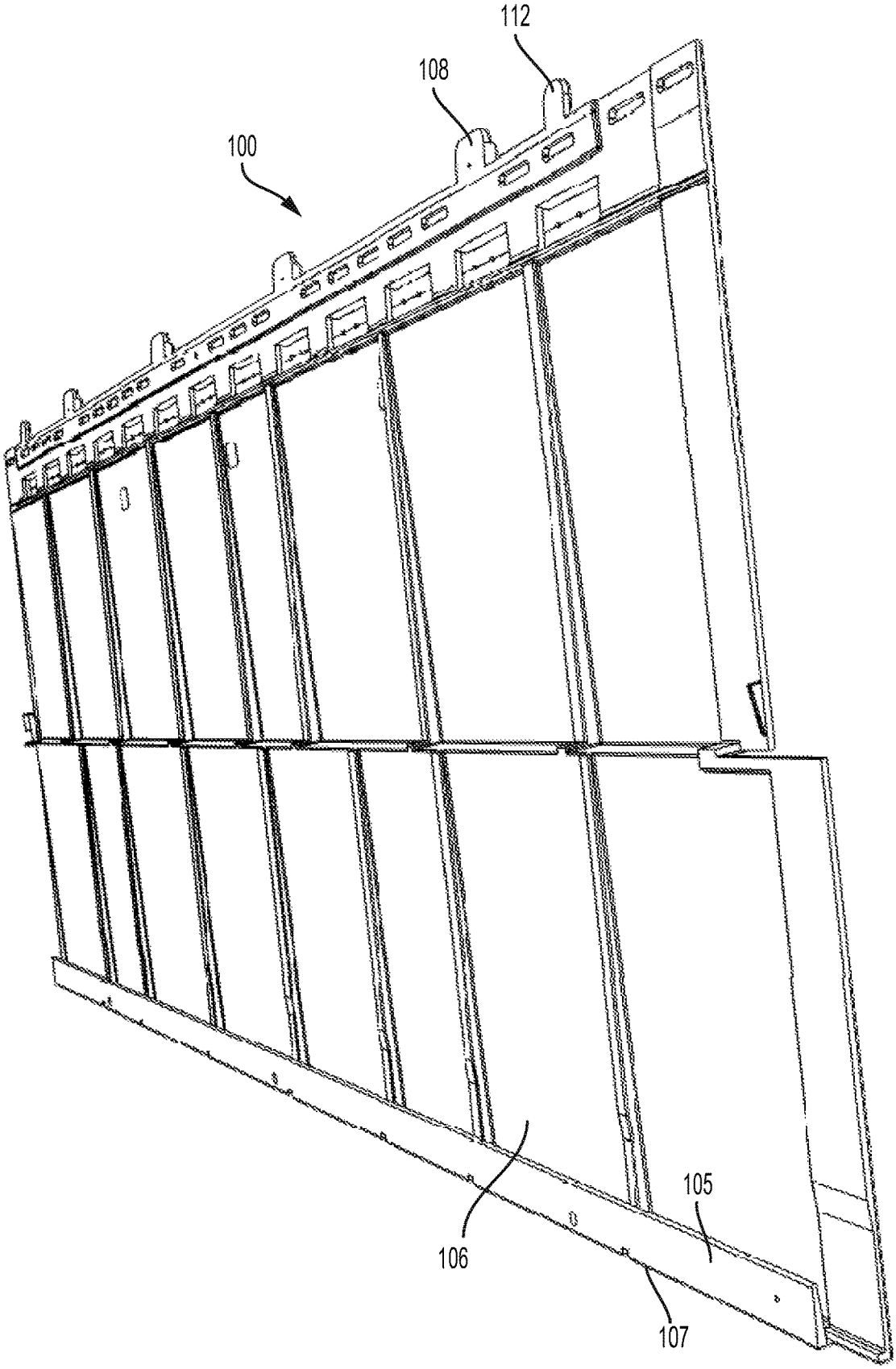
FIG. 4 is a schematic perspective view of a rear face of an exterior cladding panel according to another embodiment of the disclosure.

A locking leg 105 may extend from a rear face 106 of the exterior cladding panel 100, as shown in the schematic rear view of FIG. 2. For instance, the locking leg 105 may be positioned along a bottom edge 107 of the exterior cladding panel 100, which may be seen more clearly in the rear perspective view of FIG. 4 or the side views in FIGS. 8 and 9. The locking leg 105 may be sized to engage the locking clip 103 of a vertically adjacent exterior cladding panel, which may be, in some examples, another exterior cladding panel 100.

The exterior cladding panel 100 may further include a first plurality of tabs 108 extending from a top edge 109 of the exterior cladding panel 100. Each tab in the first plurality of tabs 108 includes at least one projection extending approximately perpendicular to the front face 104 of the exterior cladding panel 100, and perpendicular to the top edge 109 of the exterior cladding panel 100. For the example exterior cladding panel 100 as shown in the Figures and discussed herein, the at least one projection may include a first projection 110*a* and a second projection 110*b*.

Figure 5:
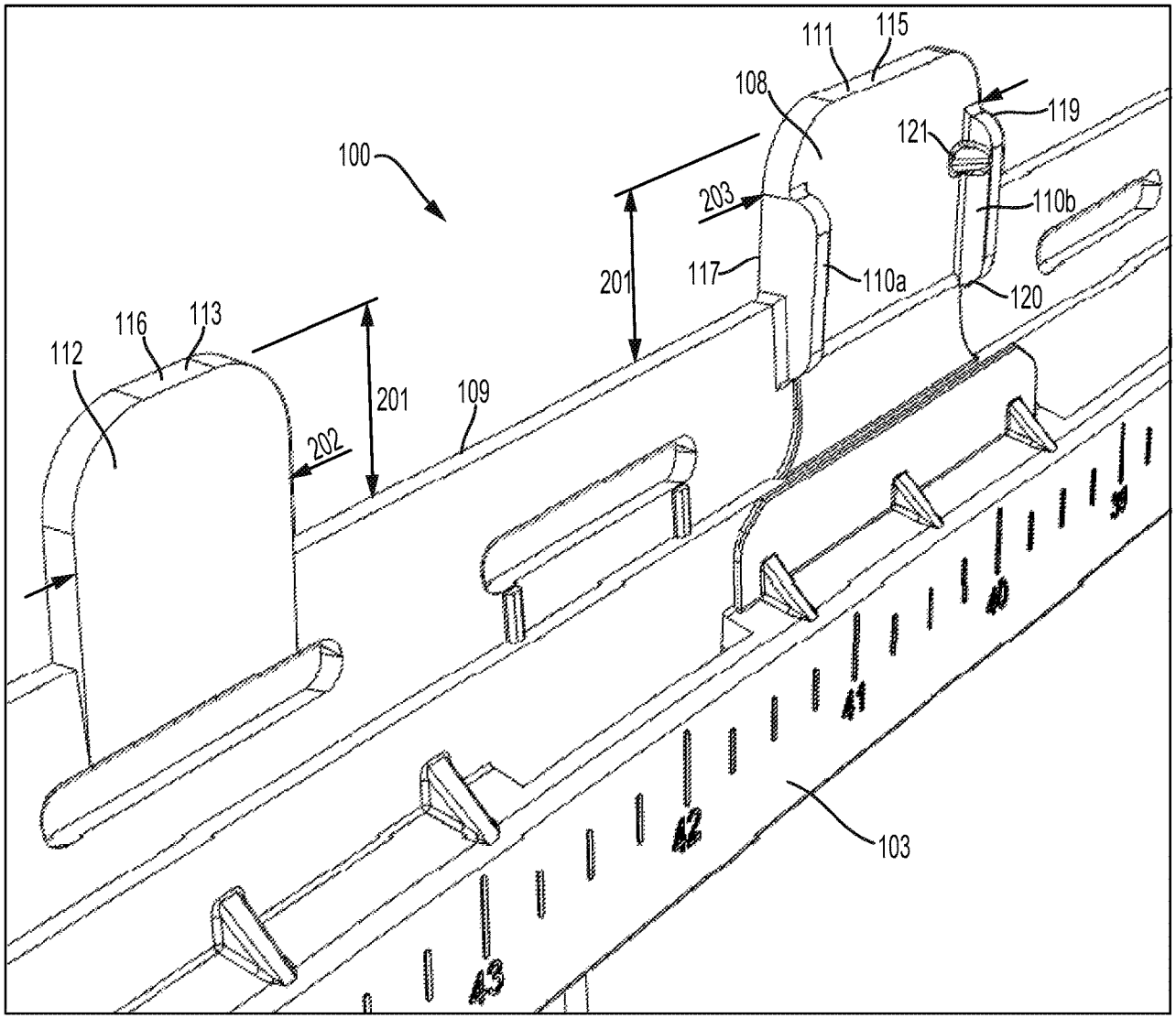
FIG. 5 is a schematic perspective view of a top edge of an exterior cladding panel according to another embodiment of the disclosure.

For instance, FIG. 5 shows a schematic perspective view of the top edge 109 of the exterior cladding panel 100, including one of the tabs 108 in the first plurality of tabs. In some embodiments as otherwise described herein, for each tab 108 in the first plurality of tabs, the at least one projection may include a first projection 110*a* positioned at a first side edge 117 of the tab, and a second projection 110*b* positioned at a second side edge 118 of the tab opposite the first side edge 117. In some other examples, each tab 108 may include only a single projection, which might extend from the middle of the tab 108. The projections may be utilized during installation of the exterior cladding panel 100, to fine tune the horizontal position the exterior cladding panel 100 before it is fully secured to the exterior sheathing of a wall structure.

For example, the locking leg 105 of the exterior cladding panel 100 may be engaged with the locking clip 103 of an adjacent panel, which may loosely secure the exterior cladding panel 100 in place while still allowing some lateral movement of the exterior cladding panel 100. Before fastening the top end 102 of the exterior cladding panel 100 to the exterior sheathing, an installer may adjust the lateral position of the exterior cladding panel 100 by applying a lateral force to the projection. For instance, the installer my strike or tap one of the projections, such as with a hammer, to move the exterior cladding panel 100 left or right in small increments.

In some embodiments as otherwise described herein, each projection, such as the projection 110*a* shown in FIG. 5, may extend lengthwise from a respective top end 119 of the projection 110*a* to a respective bottom end 120 of the projection 110*a*. Further, the respective bottom end 120 of the projection 110*a* may be positioned below the top edge 109 of the exterior cladding panel 100. This may provide the projection 110*a* additional stability, as well as giving the project a greater length, making it easier to strike.

In some implementations, each projection, such as the projection 110*b*, may include at least one respective lateral brace, such as the lateral brace 121 shown in FIG. 5. For instance, the lateral brace 121 may abut the projection 110*b* and extend parallel to the top edge 109 of the exterior cladding panel 100, as well as approximately perpendicular to the front face 104 of the exterior cladding panel 100. In some examples, as seen in FIG. 5, the lateral brace 121 may be positioned on a side of the projection opposite where the projection is expected to be struck, for lateral positioning purposes. For instance, the projection 110*b* may be expected to be struck from the right side (to move the exterior cladding panel 100 to the left), and thus the lateral brace 121 is positioned on the left side of the projection 110*b*, providing support to the projection 110*b* against the applied force.

As noted above, trimming or cutting the exterior cladding panel 100 to fit in some examples discussed herein may be difficult, due to its intentionally irregular shape and lack of a straight edge that may be braced against a saw fence. Therefore, in some implementations, a respective top end 111 of each tab 108 in the first plurality of tabs 108 may extend a common distance 201 from the top edge 109 of the exterior cladding panel 100. In this way, because each tab 108 extends the same distance from the top edge 109, the top ends of the tabs 108 may be abutted against the saw fence while maintaining the top edge 109 of the exterior cladding panel 100 in a parallel alignment with the saw fence.

However, in some embodiments, the first plurality of tabs 108 may not be numerous enough to provide the desired level of support for the exterior cladding panel 100 while on the cutting surface. Further, increasing the number of tabs 108 in the first plurality of tabs 108 may not be an efficient solution, as the addition of more small, detailed components such as the projection 110*a* and the lateral brace 121 may increase the complexity of the injection molding process by requiring additional pressure within the mold, additional injection gates, or both.

Therefore, in certain implementations, the exterior cladding panel 100 may include a second plurality of tabs 112 extending from the top edge 109 of the exterior cladding panel 100. The tabs 112 may be a simplified version of the tabs 108, as can be seen in FIGS. 1-5. For instance, each tab 108 in the first plurality of tabs may have a first width 203, while each tab 112 in the second plurality of tabs has a second width 202 that is less than the first width 203. Further, each tab 112 may lack the projections extending approximately perpendicular to the front face 104 of the exterior cladding panel 100 that are included on the tabs 108. Thus, the tabs 112 may not be effective for lateral positioning of the exterior cladding panel 100, as the first tabs 108 are.

Nonetheless, a respective top end 113 of each tab 112 in the second plurality of tabs 112 may extend the common distance 201 from the top edge 109 of the exterior cladding panel 100, the same as the first plurality of tabs 108. Consequently, the second plurality of tabs 112 may be used in conjunction with the first plurality of tabs 108 to square the exterior cladding panel 100 against a saw fence for more accurate cutting of the exterior cladding panel 100.

In some embodiments as otherwise described herein, each tab 108 in the first plurality of tabs 108 may include a respective top end 111 that has a first flat surface 115 parallel to the top edge of the exterior cladding panel 100, as shown in FIG. 5. Further, a respective top end 113 of each tab 112 in the second plurality of tabs 112 may also include a second flat surface 116 that is parallel to the top edge 109 of the exterior cladding panel 100. In this way, the tabs 108 and 112 may provide further stability to the exterior cladding panel 100 when it is abutted against a saw fence for cutting of the exterior cladding panel 100.

Figure 6:
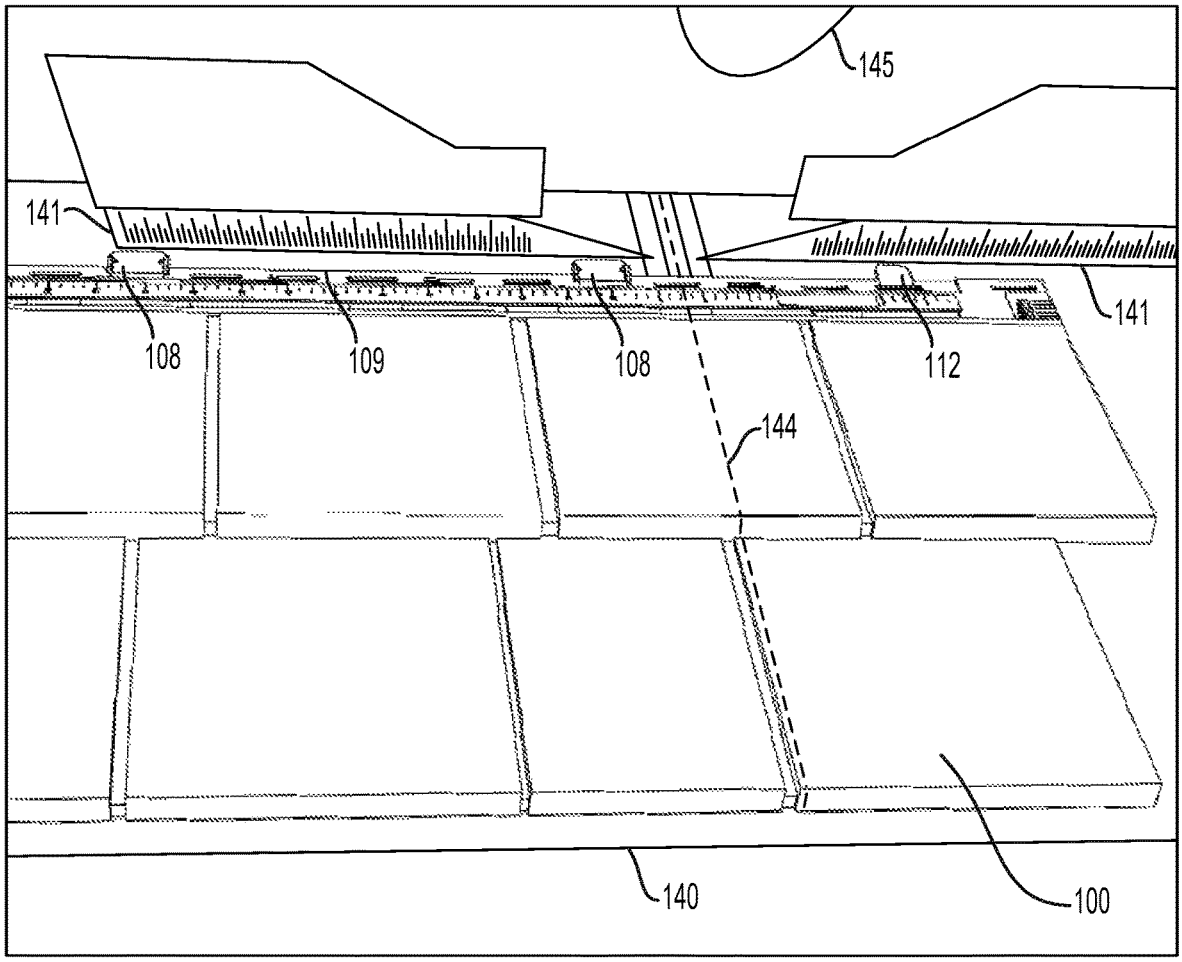
FIG. 6 is a schematic perspective view of an exterior cladding panel on a cutting surface according to another embodiment of the disclosure.

An example of such an implementation is shown in FIG. 6, which shows an example exterior cladding panel 100 lying on a cutting surface 140. A saw fence 141 extends vertically from the cutting surface 140, and the exterior cladding panel 100 is abutting the saw fence 141 by way of at least two tabs 108 and at least one tab 112 extending from the top edge 109 of the exterior cladding panel 100. This may improve the stability of the exterior cladding panel 100 as it is cut along a line 144 by a saw 145, for example.

Figure 7:
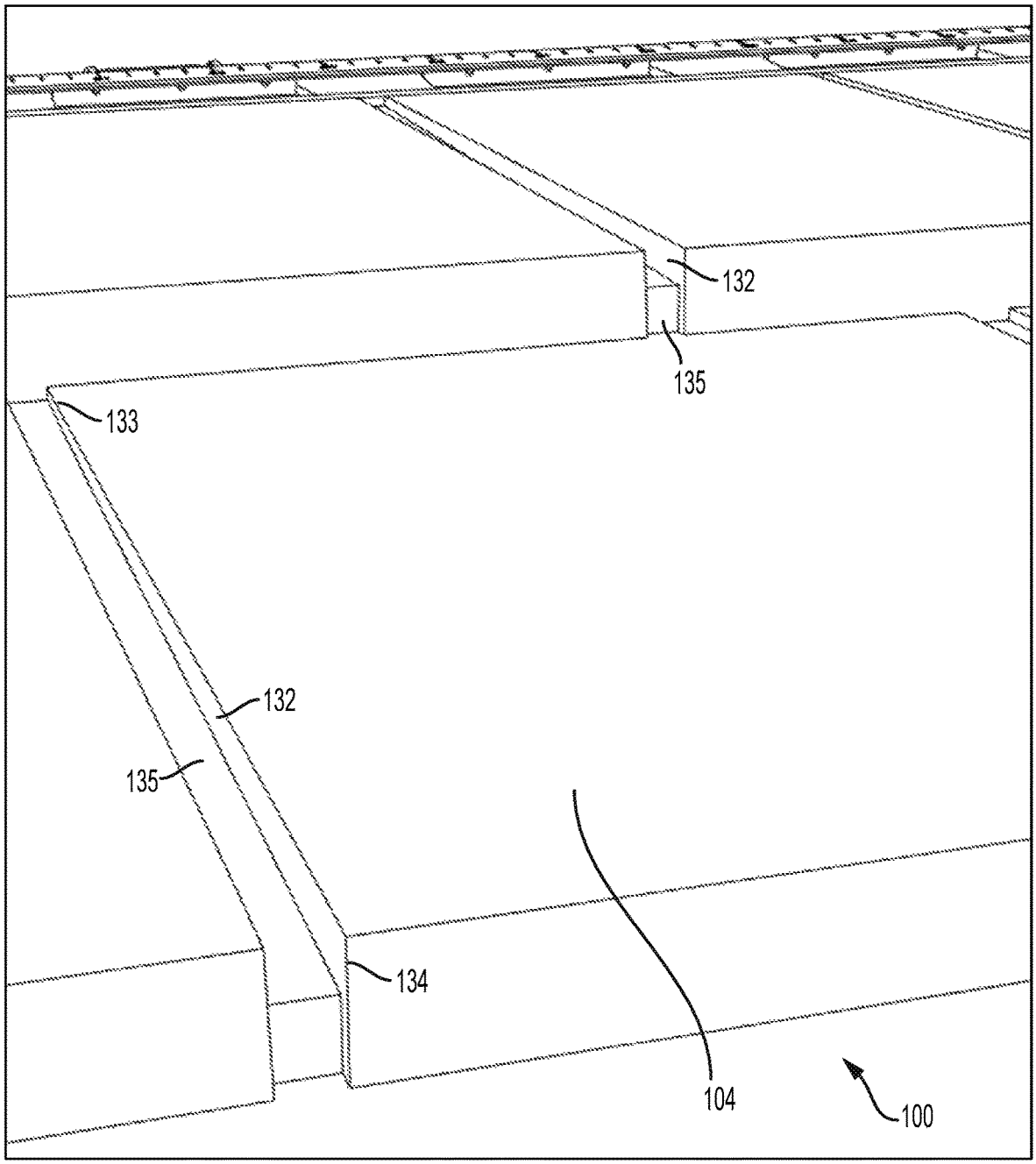
FIG. 7 is another schematic perspective view of a front face of an exterior cladding panel according to another embodiment of the disclosure.

In addition to the randomized widths of the simulated shingles and gaps in each course, the exterior cladding panel 100 may include additional features to further simulate the appearance of traditional cedar shake siding. For example, FIG. 7 provides a closer view of some of the gaps between shingles in the exterior cladding panel 100. In particular, FIG. 7 illustrates that, in some embodiments as otherwise described herein, each gap in the series of gaps 131 may include a depth 132 measured normal to the front face 104 of the exterior cladding panel 100. Further, the depth 132 of each gap in the series of gaps 131 increases from a top end 133 of the gap 131 toward a bottom end 134 of the gap 131.

For instance, as shown in FIG. 7, the exterior cladding panel 100 may include a recessed portion 135 that is positioned within each gap 131, which may provide additional structural integrity for the exterior cladding panel 100. Accordingly, the depth 132 of each gap 131 may be measured from the front face 104 of the exterior cladding panel 100 to the recessed portion 117 of the exterior cladding panel 100. The depth 132 may be relatively shallow at the top end 133 of each gap 131, and may then increase along the length of each gap 132, as shown in FIG. 7.

This variation in the depth 132 along each gap 131 may provide variation in the shadow line created by each gap 131, which may be desirable in some implementations. In some embodiments, the gradient or slope of the recessed portion 135 within each gap may be the same, and thus the depth 132 of each gap 131 with vary in the same manner. In other embodiments, the slope of the recessed portion 135 may differ between different gaps, which, in combination with other examples discussed herein, may result in gaps having both a differing width and a differing depth within the series of gaps 131.

Figure 8:
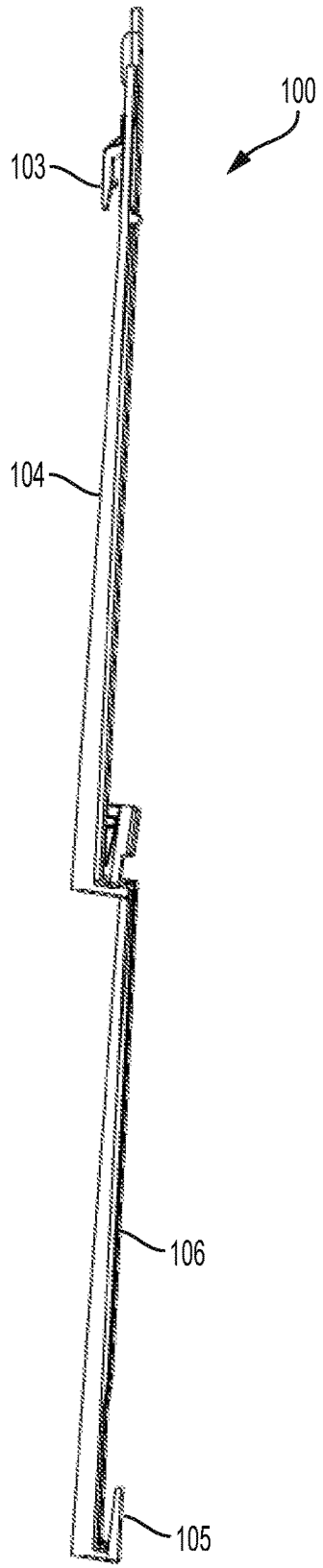
FIG. 8 is a schematic right side view of an exterior cladding panel according to another embodiment of the disclosure.
Figure 9:
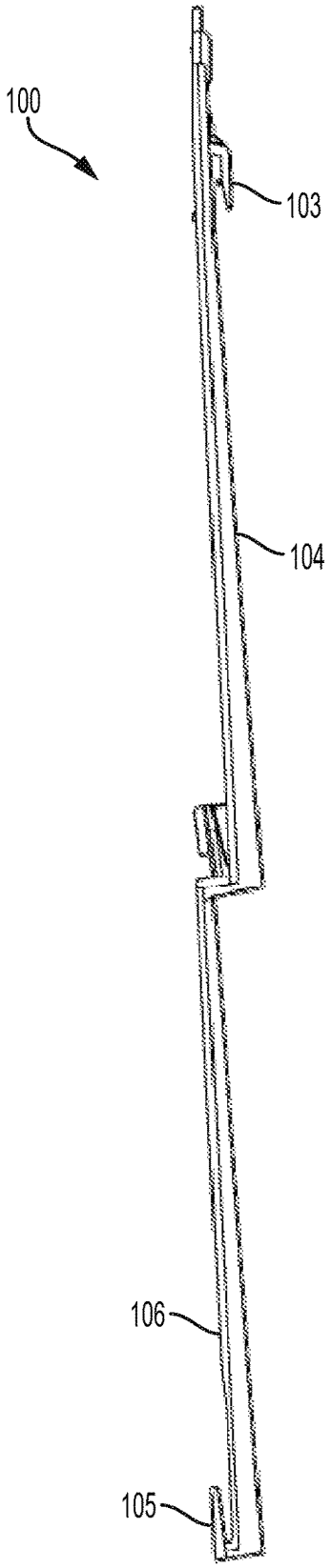
FIG. 9 is a schematic left side view of an exterior cladding panel according to another embodiment of the disclosure.

Turning now to FIGS. 8 and 9, a schematic right side view and a schematic left side view of an example exterior cladding panel 100 are shown, respectively. Some of the features discussed above can be seen, including the locking clip 103 and the locking leg 105.

Figure 10:
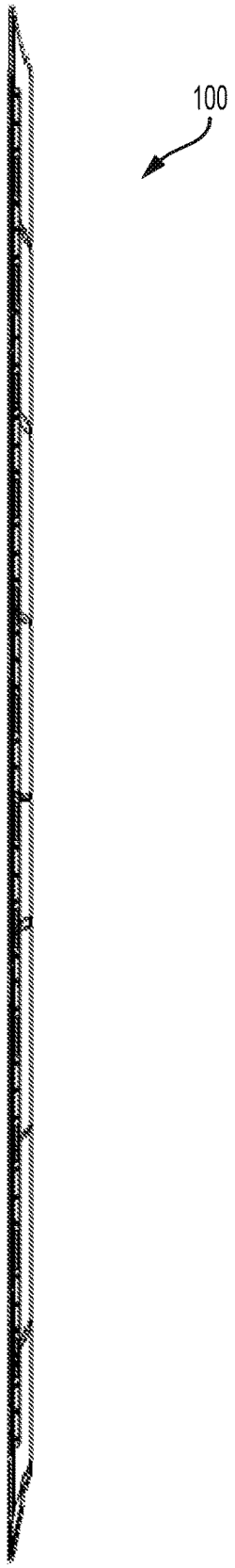
FIG. 10 is a schematic top view of an exterior cladding panel according to another embodiment of the disclosure.
Figure 11:
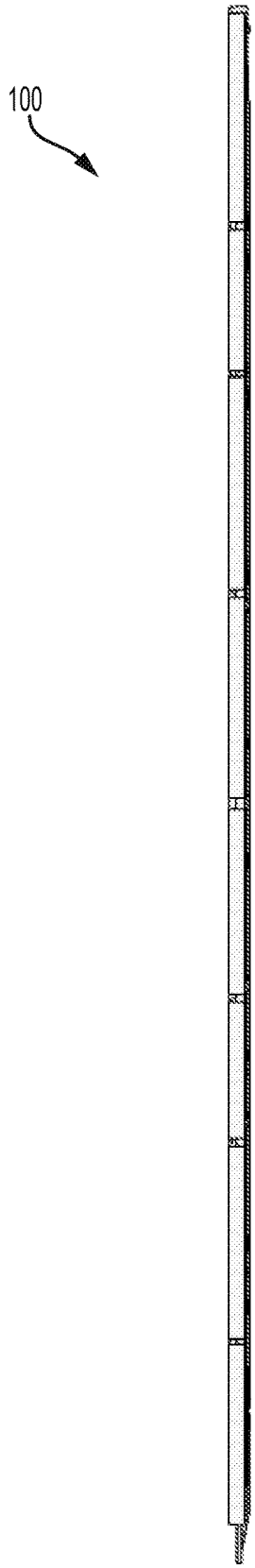
FIG. 11 is a schematic bottom view of an exterior cladding panel according to another embodiment of the disclosure.

FIGS. 10 and 11 depict a schematic top view and a schematic bottom view, respectively, of an example exterior cladding panel 100. Due to the relatively thin profile of the exterior cladding panel 100, relatively few features of the exterior cladding panel 100 are visible in the top and bottom views shown in FIGS. 10 and 11.

Another embodiment of the disclosure is an exterior cladding system that includes a plurality of exterior cladding panels, such as the exterior cladding panel 100 as discussed in the examples above. For example, FIG. 12 shows a schematic perspective view of an exterior cladding system 300 according to another embodiment of the disclosure.

However, it will be understood that the exterior cladding system 300 need not be installed for all components of the system to be present. For instance, the exterior cladding system 300 may include a first exterior cladding panel 100*a* and a second exterior cladding panel 100*b*, both of which may be substantially similar or the same as the exterior cladding panel 100 shown in FIGS. 1-11 and discussed in examples herein. Further, the locking leg 105 of the second exterior cladding panel 100*b* may be sized to engage the locking clip 103 of the first exterior cladding panel 100*a*.

Figure 12:
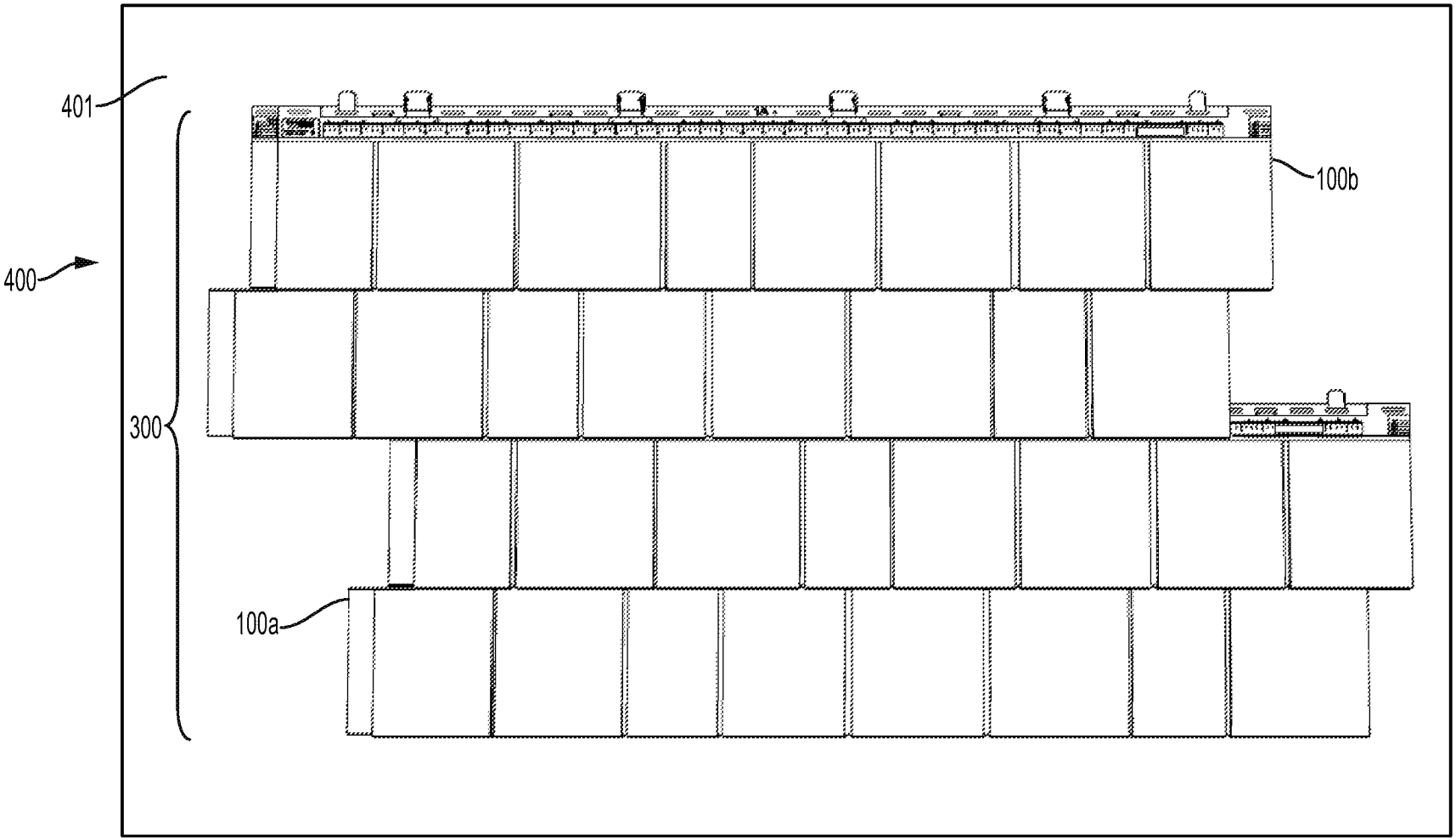
FIG. 12 is a schematic perspective view of an exterior cladding system according to another embodiment of the disclosure.

Further, FIG. 12 shows a wall 400 of a structure including an exterior sheathing 401, and the exterior cladding system 300 as discussed in some of the examples above attached thereto. For instance, the exterior cladding panel 100*a* may be fastened to the exterior sheathing 401 via a fastening strip disposed along an edge of the first end of the exterior cladding panel 100*a*, such as the fastening strip 122 shown with respect to the exterior cladding panel 100 in FIG. 1. Further, the locking leg of the second exterior cladding panel 100*b*, which may be substantially similar to or the same as the locking leg 105 shown in the Figures and discussed above, may be engaged with the locking clip of the first exterior cladding panel 100*a*. The locking clip may be substantially similar to or the same the locking clip 103 shown in the Figures are discussed above.

Figure 13:
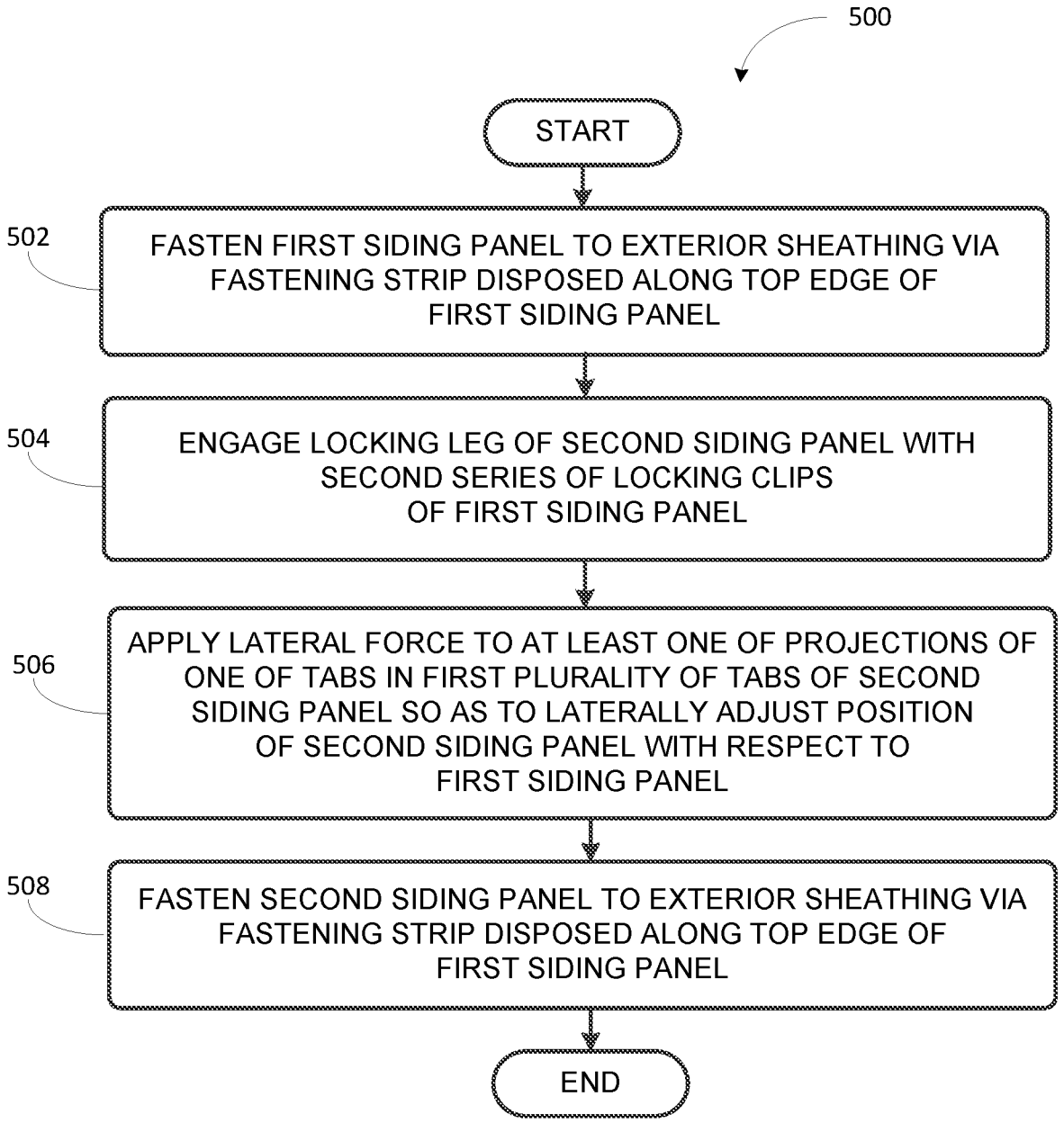
FIG. 13 is a block diagram of a method for installing an exterior cladding system according to another embodiment of the disclosure.

FIG. 13 is a block diagram of a method 500 for installing a exterior cladding system, such as the exterior cladding system 300 according to some examples discussed herein, onto a wall of a structure according to an embodiment of the disclosure.

At block 502, the method 500 includes fastening the first exterior cladding panel 100*a* to the exterior sheathing 401 via a fastening strip disposed along the top edge of the first exterior cladding panel 100*a*. For example, the fastening strip may be substantially similar to or the same as fastening strip 122 shown with respect to the exterior cladding panel 100 in FIG. 1, and the first exterior cladding panel 100*a* may be fastened to the exterior sheathing 401 via nails driven through slots in the fastening strip 122. Staples and other fasteners may be utilized as well.

At block 504, the method 500 includes engaging the locking leg, such as the locking leg 105 as discussed above, of the second exterior cladding panel 100*b* with the locking clip, such as the locking clip 103, of the first exterior cladding panel 100*a*.

At block 506, the method 500 includes applying a lateral force to at least one of the projections of one of the tabs 108 in the first plurality of tabs 108 of the second exterior cladding panel 100*b*. The force may be applied so as to laterally adjust a position of the second exterior cladding panel 100*b* with respect to the first exterior cladding panel 100*a*. For instance, applying the lateral force may include striking the at least one of the projections with a hammer. Other possibilities also exist.

At block 508, the method 500 includes fastening the second exterior cladding panel 100*b* to the exterior sheathing 401 via a fastening strip disposed along the top edge of the second exterior cladding panel 100*b*. As noted above, the fastening strip may be the substantially similar to or the same as fastening strip 122 disposed along the top edge 109 of the exterior cladding panel 100 shown in FIG. 1.

As noted above, the exterior cladding panel as discussed herein may need to be cut to a particular size before it is installed on the exterior sheathing 401 of the wall 400. Thus, in some examples, the method 500 may further include, before fastening the first exterior cladding panel 100*a* to the exterior sheathing 401, positioning the first exterior cladding panel 100*a* on a cutting surface 140. Positioning the first exterior cladding panel 100*a* on the cutting surface 140 may include abutting at least one tab 108 of the first plurality of tabs 108 and at least one tab 112 of the second plurality of tabs 112 against a saw fence 141, such that the top edge 109 of the first exterior cladding panel 100*a* is substantially parallel to the saw fence 141, as can be seen in FIG. 6.

While the first exterior cladding panel 100*a* is positioned on the cutting surface 140 such that the top edge 109 of the first exterior cladding panel 100 is substantially parallel to the saw fence 141, the method 500 may further include cutting the first exterior cladding panel 100*a* to a predetermined length, such as with a miter saw.

Figure 14:
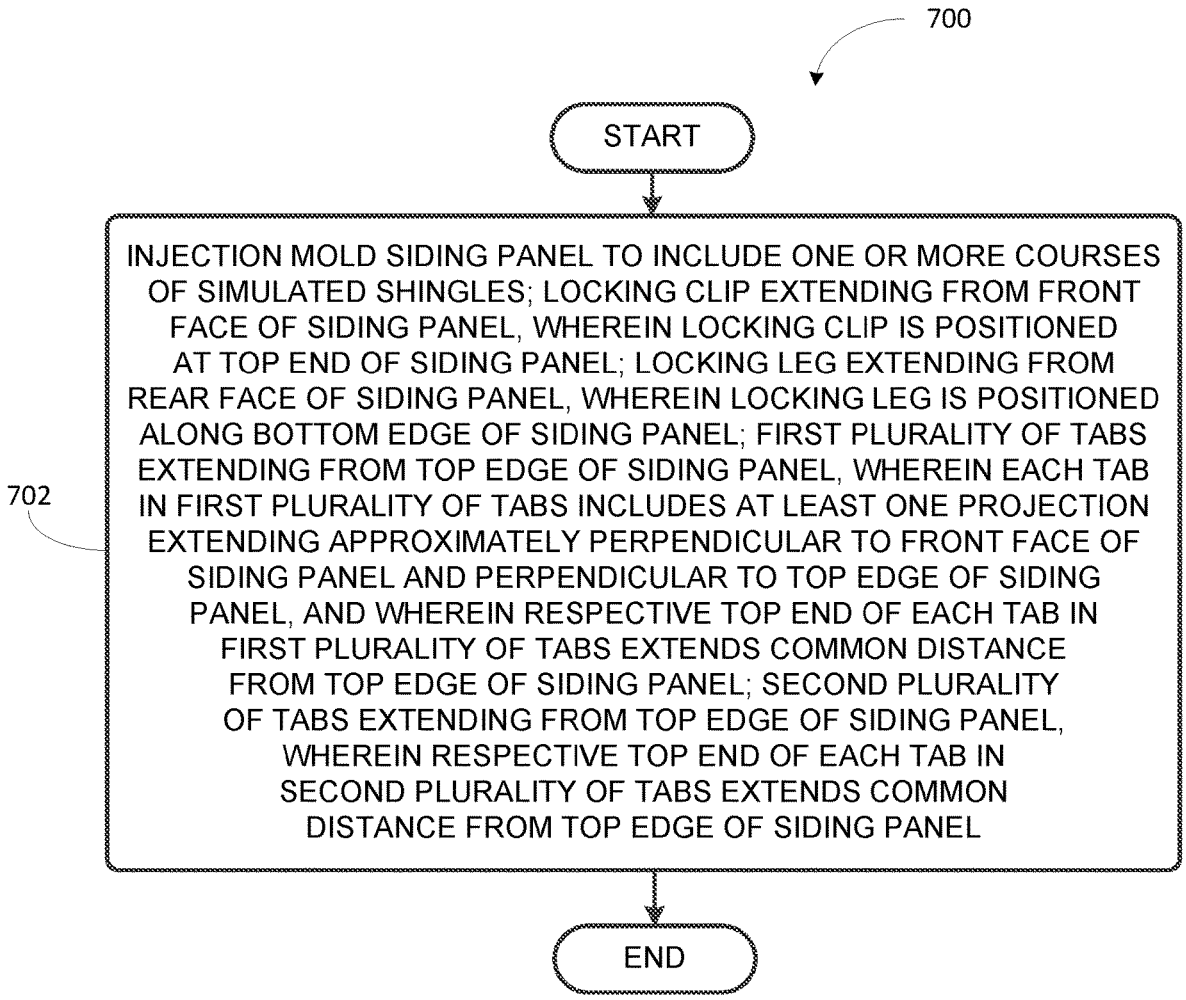
FIG. 14 is a block diagram of a method for forming an exterior cladding system according to another embodiment of the disclosure.

FIG. 14 is a block diagram of a method 600 for forming an exterior cladding panel, such as the exterior cladding panel 100 discussed herein, according to another embodiment of the disclosure.

At block 602, the method 600 includes injection molding the exterior cladding panel 100 to include one or more courses of simulated shingles. In some implementations, injection molding the one or more courses of simulated shingles may include, for each course of simulated shingles, forming a series of simulated shingles 130 and a series of gaps 131 separating adjacent shingles in the series of simulated shingles.

The method 600 may also include injection molding the exterior cladding panel 100 to include a locking clip 103 extending from a front face 104 of the exterior cladding panel 100, where the locking clip 103 is positioned at a top end 102 of the exterior cladding panel 100, as shown in at least FIG. 1. In some embodiments, injection molding the exterior cladding panel 100 to include the locking clip 103 may include forming a single, continuous locking clip 103 extending from approximately a first side 142 of the exterior cladding panel 100 to approximately a second side 143 of the exterior cladding panel 100, as discussed above. The exterior cladding panel 100 may further be injection molded to include a locking leg 105 extending from a rear face 106 of the exterior cladding panel 100, where the locking leg 105 is positioned along a bottom edge 107 of the exterior cladding panel 100, as shown in at least FIG. 2.

The exterior cladding panel 100 may further be injection molded to include a first plurality of tabs 108 extending from a top edge 109 of the exterior cladding panel 100, where each tab 108 in the first plurality of tabs 108 includes at least one projection extending approximately perpendicular to the front face 104 of the exterior cladding panel 100 and perpendicular to the top edge 109 of the exterior cladding panel 100, and where a respective top end 111 of each tab 108 in the first plurality of tabs 108 extends a common distance 201 from the top edge 109 of the exterior cladding panel 100, as discussed above and shown in the Figures.

The method 600 may also include injection molding the exterior cladding panel 100 to include a second plurality of tabs 112 extending from the top edge 109 of the exterior cladding panel 100, where a respective top end 113 of each tab 112 in the second plurality of tabs 112 extends the common distance 201 from the top edge 109 of the exterior cladding panel 100.

In some embodiments as otherwise described herein, injection molding the first plurality of tabs 108 may include forming each tab 108 in the first plurality of tabs 108 to have a first width 203. Further, injection molding the second plurality of tabs 112 may include forming each tab 112 in the second plurality of tabs 112 to have a second width 202 less than the first width 203. Further, injection molding the exterior cladding panel 100 to include the second plurality of tabs 112 may include forming each tab 112 in the second plurality of tabs 112 without a projection extending approximately perpendicular to the front face 104 of the exterior cladding panel 100.

In some implementations, injection molding the first plurality of tabs may include forming each respective top end 111 of each tab 108 in the first plurality of tabs 108 to have a first flat surface 115 parallel to the top edge 109 of the exterior cladding panel 100. Further, injection molding the second plurality of tabs 112 may include forming each respective top end 113 of each tab 112 in the second plurality of tabs 112 to have a second flat surface 116 parallel to the top edge 109 of the exterior cladding panel 100.

Further, the method 600 may include, for each tab 108 in the first plurality of tabs 108, injection molding the at least one projection to include a first projection 110*a* positioned at a first side 117 of the tab 108, and a second projection 110*b* positioned at a second side 118 of the tab 108 opposite the first side 117. In some implementations, injection molding each projection may further include forming each projection to extend lengthwise from a respective top end 119 of the projection to a respective bottom end 120 of the projection, where the bottom end 120 of the projection is positioned below the top edge 109 of the exterior cladding panel 100.

In some embodiments as otherwise described herein, injection molding each projection may also include forming at least one respective lateral brace 121 abutting the projection and extending approximately perpendicular to the front face 104 of the exterior cladding panel 100 and parallel to the top edge 109 of the exterior cladding panel 100.

In some implementations, injection molding each gap 131 in the series of gaps 131 may include forming each gap 131 to include a depth 132 measured normal to the front face 104 of the exterior cladding panel 100, where the depth 132 of each gap 131 in the series of gaps increases from a top end 133 of the gap 131 toward a bottom end 134 of the gap 131.

Conventional methodologies for exterior cladding construction can be used in the installation and formation of the exterior cladding panels as described herein. Further, the embodiments and implementations described herein, in conjunction with the Figures, have generally discussed a exterior cladding system and an exterior cladding panel that is oriented with horizontally arranged courses, with reference to courses and adjacent exterior cladding panels positioned in series both above and below. However, one of ordinary skill in the art will recognize that the exterior cladding panels, systems, and methods described herein are not limited to a horizontal arrangement. For instance, in certain embodiments as otherwise described herein, the exterior cladding panels and exterior cladding systems described above may be installed vertically, or at any angle between zero and ninety degrees. Exterior cladding panels may be installed in an orientation that matches the underlying surface to which the exterior cladding panels are applied, for instance, as well as for a variety of visual, structural, and/or thermal effects and performance.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. An exterior cladding panel comprising:

one or more courses of simulated shingles;

a locking clip extending from a front face of the exterior cladding panel, wherein the locking clip is positioned at a top end of the exterior cladding panel;

a locking leg extending from a rear face of the exterior cladding panel, wherein the locking leg is positioned along a bottom edge of the exterior cladding panel;

a first plurality of tabs extending from a top edge of the exterior cladding panel, wherein each tab in the first plurality of tabs comprises at least one projection extending approximately perpendicular to the front face of the exterior cladding panel and perpendicular to the top edge of the exterior cladding panel, and wherein a respective top end of each tab in the first plurality of tabs extends a common distance from the top edge of the exterior cladding panel; and a second plurality of tabs extending from the top edge of the exterior cladding panel, wherein a respective top end of each tab in the second plurality of tabs extends the common distance from the top edge of the exterior cladding panel, wherein each tab in the first plurality of tabs comprises a first width, and wherein each tab in the second plurality of tabs comprises a second width less than the first width.

2. The exterior cladding panel of claim 1, wherein each respective top end of each tab in the first plurality of tabs comprises a first flat surface parallel to the top edge of the exterior cladding panel, and wherein each respective top end of each tab in the second plurality of tabs comprises a second flat surface parallel to the top edge of the exterior cladding panel.

3. The exterior cladding panel of claim 1, wherein for each tab in the first plurality of tabs, the at least one projection consists of a first projection positioned at a first side edge of the tab, and a second projection positioned at a second side edge of the tab opposite the first side edge.

4. The exterior cladding panel of claim 1, wherein each projection of the at least one projection comprises at least one respective lateral brace abutting the projection extending parallel to the top edge of the exterior cladding panel and approximately perpendicular to the front face of the exterior cladding panel.

5. The exterior cladding panel of claim 1, wherein, each tab in the second plurality of tabs lacks a projection extending approximately perpendicular to the front face of the exterior cladding panel.

6. The exterior cladding panel of claim 1, wherein the locking clip is formed as a single, continuous locking clip extending from approximately a first side of the exterior cladding panel to approximately a second side of the exterior cladding panel.

7. The exterior cladding panel of claim 1, wherein each course of simulated shingles in the one or more courses of simulated shingles comprises a series of simulated shingles and a series of gaps separating adjacent simulated shingles in the series of simulated shingles.

8. An exterior cladding system comprising:

a first exterior cladding panel and a second exterior cladding panel, each according to claim 1, wherein the locking leg of the second exterior cladding panel is sized to engage the locking clip of the first exterior cladding panel.

9. A wall of a structure comprising an exterior sheathing and the exterior cladding system of claim 8 attached thereto, wherein the first exterior cladding panel is fastened to the exterior sheathing via a fastening strip disposed along the top edge of the first exterior cladding panel, and wherein the locking leg of the second exterior cladding panel is engaged with the locking clip of the first exterior cladding panel.

10. A method of installing an exterior cladding system according to claim 8, the method comprising:

fastening the first exterior cladding panel to the exterior sheathing via a fastening strip disposed along the top edge of the first exterior cladding panel;

engaging the locking leg of the second exterior cladding panel with the locking clip of the first exterior cladding panel;

applying a lateral force to at least one of the projections of one of the tabs in the first plurality of tabs of the second exterior cladding panel so as to laterally adjust a position of the second exterior cladding panel with respect to the first exterior cladding panel; and fastening the second exterior cladding panel to the exterior sheathing via a fastening strip disposed along the top edge of the second exterior cladding panel.

11. The method of claim 10, wherein applying a lateral force to at least one of the projections comprising striking the at least one of the projections with a hammer.

12. The method of claim 10, further comprising:

before fastening the first exterior cladding panel to the exterior sheathing, positioning the first exterior cladding panel on a cutting surface, wherein positioning the first exterior cladding panel on the cutting surface comprises abutting at least one tab of the first plurality of tabs and at least one tab of the second plurality of tabs against a saw fence, such that the top edge of the first exterior cladding panel is substantially parallel to the saw fence; and while the first exterior cladding panel is positioned on the cutting surface such that the top edge of the first exterior cladding panel is substantially parallel to the saw fence, cutting the first exterior cladding panel to a predetermined length.

13. A method of forming an exterior cladding panel according to claim 1, the method comprising:

injection molding the exterior cladding panel to include:

one or more courses of simulated shingles;

a locking clip extending from a front face of the exterior cladding panel, wherein the locking clip is positioned at a top end of the exterior cladding panel;

a locking leg extending from a rear face of the exterior cladding panel, wherein the locking leg is positioned along a bottom edge of the exterior cladding panel;

a first plurality of tabs extending from a top edge of the exterior cladding panel, wherein each tab in the first plurality of tabs comprises at least one projection extending approximately perpendicular to the front face of the exterior cladding panel and perpendicular to the top edge of the exterior cladding panel, and wherein a respective top end of each tab in the first plurality of tabs extends a common distance from the top edge of the exterior cladding panel; and a second plurality of tabs extending from the top edge of the exterior cladding panel, wherein a respective top end of each tab in the second plurality of tabs extends the common distance from the top edge of the exterior cladding panel.

14. The method of claim 13, wherein injection molding the first plurality of tabs comprises forming each tab in the first plurality of tabs to have a first width, and wherein injection molding the second plurality of tabs comprises forming each tab in the second plurality of tabs to have a second width less than the first width.

15. The method of claim 13, wherein injection molding each projection comprises forming each projection to extend lengthwise from a respective top end of the projection to a respective bottom end of the projection, wherein the bottom end of the projection is positioned below the top edge of the exterior cladding panel.

16. The method of claim 13, wherein injection molding the exterior cladding panel to include the locking clip comprises forming a single, continuous locking clip extending from approximately a first side of the exterior cladding panel to approximately a second side of the exterior cladding panel.

17. The method of claim 13, wherein injection molding the one or more courses of simulated shingles comprises, for each course of simulated shingles, forming a series of simulated shingles and a series of gaps separating adjacent shingles in the series of simulated shingles, and wherein injection molding each gap comprises forming each gap to include a depth measured normal to the front face of the exterior cladding panel, wherein the depth of each gap in the series of gaps increases from a top end of the gap toward a bottom end of the gap.

18. An exterior cladding panel comprising:

one or more courses of simulated shingles;

a locking clip extending from a front face of the exterior cladding panel, wherein the locking clip is positioned at a top end of the exterior cladding panel;

a locking leg extending from a rear face of the exterior cladding panel, wherein the locking leg is positioned along a bottom edge of the exterior cladding panel;

a first plurality of tabs extending from a top edge of the exterior cladding panel, wherein each tab in the first plurality of tabs comprises at least one projection extending approximately perpendicular to the front face of the exterior cladding panel and perpendicular to the top edge of the exterior cladding panel, and wherein a respective top end of each tab in the first plurality of tabs extends a common distance from the top edge of the exterior cladding panel; and a second plurality of tabs extending from the top edge of the exterior cladding panel, wherein a respective top end of each tab in the second plurality of tabs extends the common distance from the top edge of the exterior cladding panel, wherein each projection of the at least one projection extends lengthwise from a respective top end of the projection to a respective bottom end of the projection, wherein the respective bottom end of each projection is positioned below the top edge of the exterior cladding panel.

19. An exterior cladding panel comprising:

one or more courses of simulated shingles;

a locking clip extending from a front face of the exterior cladding panel, wherein the locking clip is positioned at a top end of the exterior cladding panel;

a locking leg extending from a rear face of the exterior cladding panel, wherein the locking leg is positioned along a bottom edge of the exterior cladding panel;

a first plurality of tabs extending from a top edge of the exterior cladding panel, wherein each tab in the first plurality of tabs comprises at least one projection extending approximately perpendicular to the front face of the exterior cladding panel and perpendicular to the top edge of the exterior cladding panel, and wherein a respective top end of each tab in the first plurality of tabs extends a common distance from the top edge of the exterior cladding panel; and a second plurality of tabs extending from the top edge of the exterior cladding panel, wherein a respective top end of each tab in the second plurality of tabs extends the common distance from the top edge of the exterior cladding panel, wherein each course of simulated shingles in the one or more courses of simulated shingles comprises a series of simulated shingles and a series of gaps separating adjacent simulated shingles in the series of simulated shingles, and wherein each gap in the series of gaps comprises a depth measured normal to the front face of the exterior cladding panel, and wherein the depth of each gap in the series of gaps increases from a top end of the gap toward a bottom end of the gap.

* * * * *